US006662615B2

(12) United States Patent
Hunt

(10) Patent No.: US 6,662,615 B2
(45) Date of Patent: Dec. 16, 2003

(54) METHOD TO REDUCE AIR CENTER MIDDLE MARGIN TURNAROUND FOR FOLDED TUBE APPLICATIONS

(75) Inventor: Terry Joseph Hunt, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/128,551

(22) Filed: Apr. 23, 2002

(65) Prior Publication Data

US 2003/0196324 A1 Oct. 23, 2003

(51) Int. Cl.[7] ..... B21D 53/04
(52) U.S. Cl. ..... 72/186; 29/890.047
(58) Field of Search ..... 72/186, 187, 196; 29/890.047

(56) References Cited

U.S. PATENT DOCUMENTS

| | | | | | |
|---|---|---|---|---|---|
| 767,883 | A | * | 8/1904 | Grafton | 72/187 |
| 1,937,466 | A | * | 11/1933 | Smith et al. | 72/187 |
| 3,318,128 | A | | 5/1967 | Rhodes | 72/187 |
| 4,262,568 | A | | 4/1981 | Wallis | 83/176 |
| 4,507,948 | A | | 4/1985 | Wallis | 72/185 |
| 4,741,192 | A | | 5/1988 | Wallis | 72/187 |
| 4,838,065 | A | | 6/1989 | Wallis | 72/185 |
| 4,953,378 | A | | 9/1990 | Wallis | 72/185 |
| 5,007,270 | A | | 4/1991 | Wallis | 72/187 |
| 5,138,861 | A | | 8/1992 | Wallis | 72/185 |
| 5,261,262 | A | | 11/1993 | Wallis | 72/185 |
| 5,732,584 | A | | 3/1998 | Prater et al. | 72/187 |
| 6,032,503 | A | | 3/2000 | Grippe | 72/184 |

* cited by examiner

*Primary Examiner*—Lowell A. Larson
(74) *Attorney, Agent, or Firm*—Patrick M. Griffin

(57) ABSTRACT

An improved air center form roll for use in combination with a like form roll to produce an accordion-like folded fin for a heat exchanger core, the form roll being of the type comprising a plurality of form discs abutted one to the other and having a plurality of star-like teeth thereabout. Points of the star-like teeth define a major diameter of the form roll and valleys between adjacent ones of the star-like teeth define a minor diameter of the form roll. The form roll further includes at least one stripper disc having no teeth therearound and interposed between at least two of the plurality of form discs wherein the stripper disc has a diameter less than the minor diameter of the form roll. The improvement to the form roll comprises a modified disc having a plurality of modified star-like teeth thereabout. The modified disc is interposed at each abutment between the stripper disc and one of the abutting form discs. The modified disc further having a major diameter defined by points of the modified star-like teeth, the major diameter of the modified disc being smaller than the major diameter of the plurality of form discs.

14 Claims, 3 Drawing Sheets

METHOD TO REDUCE AIR CENTER MIDDLE MARGIN TURNAROUND FOR FOLDED TUBE APPLICATIONS

TECHNICAL FIELD

The present invention relates to heat exchangers and more particularly to the formation of the folded fins in a heat exchanger.

BACKGROUND OF THE INVENTION

Heat exchangers for a wide variety of applications, such as radiators, heater cores, condensers, and evaporators are well known in the art and are generally of a similar basic construction. The basic construction of such a heat exchanger typically includes two headers for the input and output of a heat exchanging liquid. A plurality of regularly spaced tubes extend between the two headers to permit the heat exchanging liquid to flow therebetween. A plurality of heat conductive fins, also known as an air center, occupy spaces between each pair of adjacent tubes and are oriented to permit a flow of air therethrough. Most typically, the fins are constructed as a convoluted folded fin, which when viewed from one edge are folded in an accordion-like pattern. The folded fins are bonded, most typically metallurgically bonded, to the sides of the tubes to enhance the heat transfer from the liquid flowing in the tubes to the folded fins so that the excess heat can be convectively transferred to an air stream flowing through the fins. Features of a typical prior art heat exchanger core 10 are illustrated in FIGS. 1 and 2.

Prior art heat exchanger core 10 typically comprises a plurality of tubes 12 having an elliptical shape wherein the width of tube ends 16 are generally smaller than the width of a central section 14 of tube 12 such that central section 14 forms a compressible crown. A plurality of air centers 18 formed as accordion-like folded fins are placed between adjacent ones of tubes 12. Each air center 18 is generally comprised of a plurality of adjacent convolution legs 24, wherein each convolution leg 24 is connected to a previous leg 24 by top tip radius 20 and to a subsequent convolution leg 24 by bottom tip radius 22. Each convolution leg 24 can further have a plurality of louvers 26 formed therein for improved heat transfer properties. Prior art core 10 is assembled by abutting a plurality of tubes 12 and air centers 18 in an alternating fashion such that the tip radii 20, 22 of an air center 18 are abutted to facing sides of adjacent tubes 12. Since tubes 12 have center sections 14 that are generally wider than tube ends 16, the arranged tubes 12 and air centers 18 can then be compressed to form core 10 to a desired dimension. By compressing the stacked tubes 12 and air centers 18, tip radii 20 and 22 can be caused to substantially contact the facing sides of tubes 12. The compressed core 10 is then processed to bond tip radii 20 and 22 to tubes 12, most typically by a metallurgical bonding process.

Each air center 18 in prior art core 10 is generally formed by passing a strip of heat conductive metal through a pair of intermeshing star-shaped form rolls similar to the rolls illustrated in FIG. 6. The intermeshing of the star-shaped form rolls form the generally flat metallic strip into an accordion-like folded fin. A partial cross-section of a prior art form roll 30 is illustrated in FIG. 3 wherein FIG. 3 corresponds to the cross-section along the lines 7—7 of FIG. 6. Form roll 30 is generally comprised of a plurality of discs 32–36 wherein each disc forms a specific portion of convolution legs 24 and tip radii 20 and 22. Star-shaped discs 32–36 have a plurality of teeth about the circumference wherein each tooth has a top edge 38 and a valley 39 is defined at the bottom convergence of adjacent teeth. The teeth of outer discs 32 and 36 have a plain face 40 to form ends 25 of leg 24. Discs 33 and 35 are positioned interiorly of discs 32 and 36, and their teeth have faces 42 for forming louvers 26 in leg 24. Stripper disc 34 is positioned between discs 33 and 35. Stripper disc 34 has no teeth and has a diameter substantially less than the diameter circumscribed by valleys 39. Stripper disc 34 in combination with adjacent discs 33 and 35 define a gap 44 between discs 33 and 35 to permit a stripper finger 46 to be at least partially contained therein. Stripper finger 46 facilitates the removal of formed air center 18 from form roll 30, and thus remains below valleys 39 to permit the proper intermeshing of teeth from the discs of the two intermeshing form rolls.

The intermeshing form rolls produce three different specific characteristics of the air center 18; the angle of louvers 26, the height of air center 18, and the size of tip radii 20 and 22. The form rolls operate under minimal clearance to produce the desired effect onto the blank heat conductive strip. The placement of stripper disc 34 corresponds to middle turnaround 28 of air center 18. Stripper disc 34 does not come in contact with air center 18 but allows for the clearance of stripper finger 46 to enter form roll 30 without creating an interference with the heat conductive strip being formed thereon. The heat conductive strip is trapped by the mating top and bottom form rolls 30 and is in turn drawn over the corresponding edges 38 of the discs to form the top and bottom tip radii 20 and 22. As the clearance between form rolls is reduced, the bend radii 20 and 22 of the heat conductive strip are also reduced, thereby resulting in sharper tip radii 20 and 22. As tip radii 20 and 22 become sharper, the height of air center 18 correspondingly becomes higher. The gap 44 created by stripper disc 34 allows that portion of the heat conductive strip in the region between discs 33 and 35 to be pushed toward gap 44 rather than forming a clean bend at the radius. This interaction results in middle turnaround 28 to be at a higher height than the rest of each individual top and bottom tip radii 20 and 22. Thus, as the mating top and bottom form rolls are setting the corresponding tip radii between them, the material at gap 44 is formed at a sharper radius, resulting in a higher center height of middle margin turnaround 28 of air center 18.

During assembly, core 10 is compressed to meet a predetermined core package dimension prior to placing a header on the ends of tubes 12. The height of air centers 18 should be substantially constant from convolution to convolution since a center of excessive height will cause air center 18 to collapse. Similarly, a center height that is too low will cause the air centers 18 to drop out of the core block 10 prior to bonding air centers 18 to tubes 12. The higher middle margin turnaround 28 could thus interfere with the proper assembly of core 10. However, as previously discussed, tubes 12 have a compressible crown 14 to permit some compression of tube 12 during assembly. This compressibility allows the increased height of air center middle margin turnaround 28 to be absorbed by the compression of tubes 12.

In the past, tubes 12 have been fabricated of either welded or extruded construction. However, a folded tube 50 as shown in FIG. 4 has now been introduced into the construction of heat exchanger cores. Folded tube 50 is designed and formed to have legs 52 and 54 in middle section 56 of tube 50. Legs 52 and 54 are non-compressible thereby removing the flexibility exhibited by tube 12 having a compressible crown center section 14. The non-compressibility of center section 56 results from legs 52 and 54 bottoming out on an opposite side of the folded tube 50. The tube sections between middle portion 56 and ends 58 do however, retain a degree of compressibility. Since legs 52 and 54 align directly with the high middle margin turnaround 28 of air center 18, the excess height of middle margin turnaround 28 cannot be compensated for since center portion 56 is no longer compressible. Therefore, assembling a heat exchanger core from tubes 50 in combination with air centers 18 having an increased height middle margin turnaround 28 provide additional difficulties in insuring contact between the tip radii 20 and 22 with the sides of tubes 50 during assembly of the core 10. Further, the combination of the middle margin turnaround 28 height with the non-compressible middle portion 56 height of tube 50 can cause collapsed air centers or a poor bond therebetween if the center height is too low.

Thus, there is a need for a method of forming an air center wherein its middle margin turnaround is at or below the height of the remainder of the tip radii.

SUMMARY OF THE INVENTION

One aspect of the present invention is an improved air center form roll for use in combination with a like form roll to produce an accordion-like folded fin for a heat exchanger core. The form roll being of the type comprising a plurality of form discs abutted one to the other and having a plurality of star-like teeth thereabout. Points of the star-like teeth define a major diameter of the form roll and valleys between adjacent ones of the star-like teeth define a minor diameter of the form roll. The form roll further includes at least one stripper disc having no teeth therearound and interposed between at least two of the plurality of form discs wherein the stripper disc has a diameter less than the minor diameter of the form roll. The improvement to the form roll comprises a modified disc having a plurality of modified star-like teeth thereabout. The modified disc is interposed at each abutment between the stripper disc and one of the abutting form discs. The modified disc further having a major diameter defined by points of the modified star-like teeth, the major diameter of the modified disc being smaller than the major diameter of the plurality of form discs.

Another aspect of the present invention is a method of improving a form roll utilized to form a folded fin for use in a heat exchanger core. The form roll being of the type comprising a plurality of form discs abutted one to the other and having a plurality of star-like teeth thereabout. Points of the star-like teeth define a major diameter of the form roll and valleys between adjacent ones of the star-like teeth define a minor diameter of the form roll. The form roll further includes at least one stripper disc having no teeth therearound and interposed between at least two of the plurality of form discs to abut with the two form discs. The stripper disc has a diameter less than the minor diameter of the form roll. The method includes the steps of fabricating a plurality of modified discs, each modified disc having a plurality of modified star-like teeth thereabout and further having a major diameter defined by points of the star-like teeth, the major diameter of the modified disc being smaller than the major diameter of the plurality of form discs. One modified disc is interposed between each abutted form disc and stripper disc, and the star-like teeth of the modified disc are aligned with the star-like teeth of the form discs.

Yet another aspect of the present invention is a method of making a folded fin air center having a reduced height middle margin turnaround for use in a heat exchanger core. The method includes the steps of providing a pair of form rolls, each form roll being of the type comprising a plurality of form discs abutted one to the other and having a plurality of star-like teeth thereabout. Points of the star-like teeth define a major diameter of the form roll and valleys between adjacent ones of the star-like teeth define a minor diameter of the form roll. The form roll further includes at least one stripper disc having no teeth therearound and interposed between at least two of the plurality of form discs. The stripper disc has a diameter less than the minor diameter of the form roll. The form discs abutting the stripper disc are modified form discs having modified star-like teeth therearound. Points of the modified teeth define a major diameter of the modified disc to be less than the major diameter of the form roll. The form rolls are rotated in opposite directions in a manner to cause the star-like teeth of one form roll to intermesh with the star-like teeth of the other form roll. A blank strip of heat conductive material is fed between the rotating form rolls. The teeth of each form roll are allowed to engage the blank strip. The blank strip is then formed over the point of an opposing tooth to form a tip radius adjoining two legs of a folded fin. The strip is caused to be further drawn over the point of the opposing tooth to form a leg having a middle margin turnaround in the region over the modified discs and the stripper disc wherein the height in this region is less than the height of the remainder of the leg over the region of the plurality of form discs.

These and other advantages of the invention will be further understood and appreciated by those skilled in the art by reference to the following written specification, claims and appended drawings.

DETAILED DESCRIPTION OF THE PREFERRED EMBODIMENT

Figure 7:
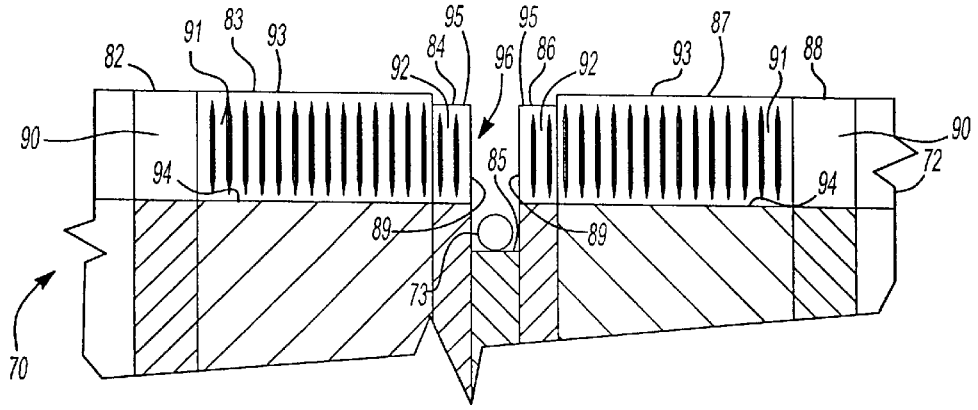
FIG. 7 is a partial cross-sectional view of the disk stack of FIG. 6 taken along the Line 7—7.

For purposes of description herein, the terms "upper", "lower", "left", "rear", "right", "front", "vertical", "horizontal", and derivatives thereof shall relate to the invention as oriented in FIG. 7. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
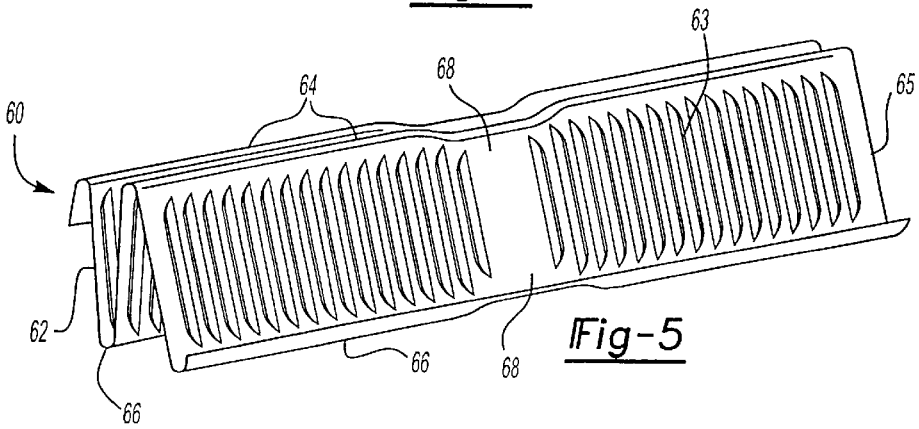
FIG. 5 is a is an elevation front view of an air-center fin formed according to a preferred embodiment of the present invention.

Turning to the drawings, FIG. 5 shows an air center 60 having a leg 62 with middle margins 68 of reduced height formed by form rolls 70 which include one of the preferred embodiments of the present invention and is illustrative of its various components.

Figure 6:
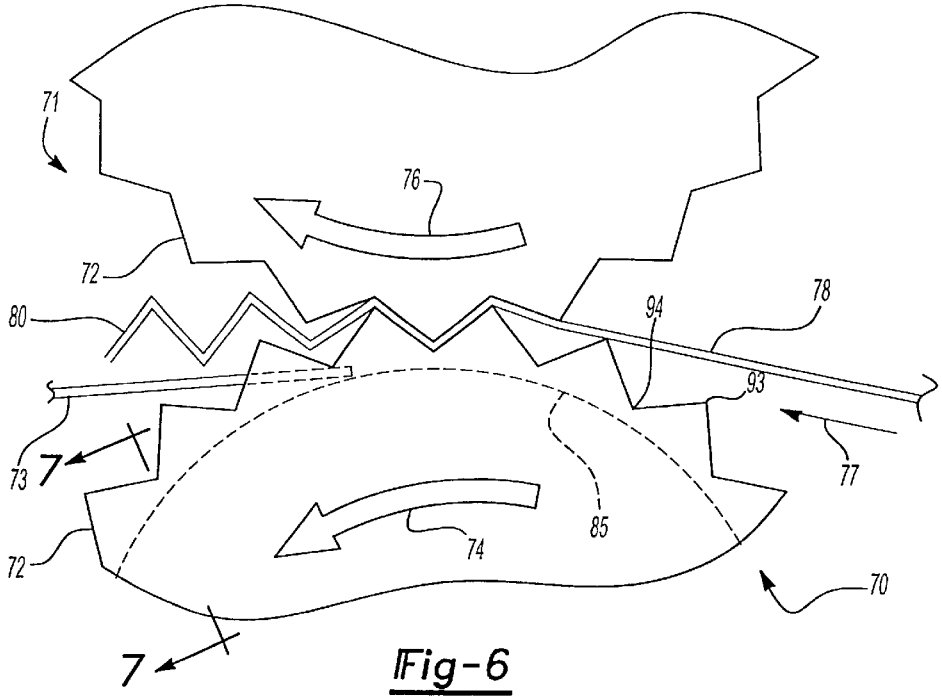
FIG. 6 is a is a side elevation view of the intermeshing disk stack utilized to form the air center fins with a reduced center margin.

Turning to FIGS. 6–7, interneshing form rolls 70 and 71 according to an embodiment of the present invention are shown rotating in their respective rotational directions 74 and 76. When blank heat conductive strip 78 is fed between form rolls 70 and 71 in direction 77, teeth 72 of form rolls 70 and 71 engage strip 78 to create folded strip 80. Folded strip 80 is later cut to various lengths to form the air center 60 as illustrated in FIG. 5.

Air center 60 is formed in an accordion-like manner and includes a plurality of legs 62 wherein leg 62 is adjoined to a previous leg 62 by top tip radius 64 and is also connected to a subsequent leg 62 by bottom tip radius 66. Each tip radii 64 and 66 has a middle margin turnaround 68 wherein the height of leg 62 from top tip radius 64 to bottom tip radius 66 is smaller at middle margin turnaround 68 than at the remaining portions of leg 62.

Figure 1:
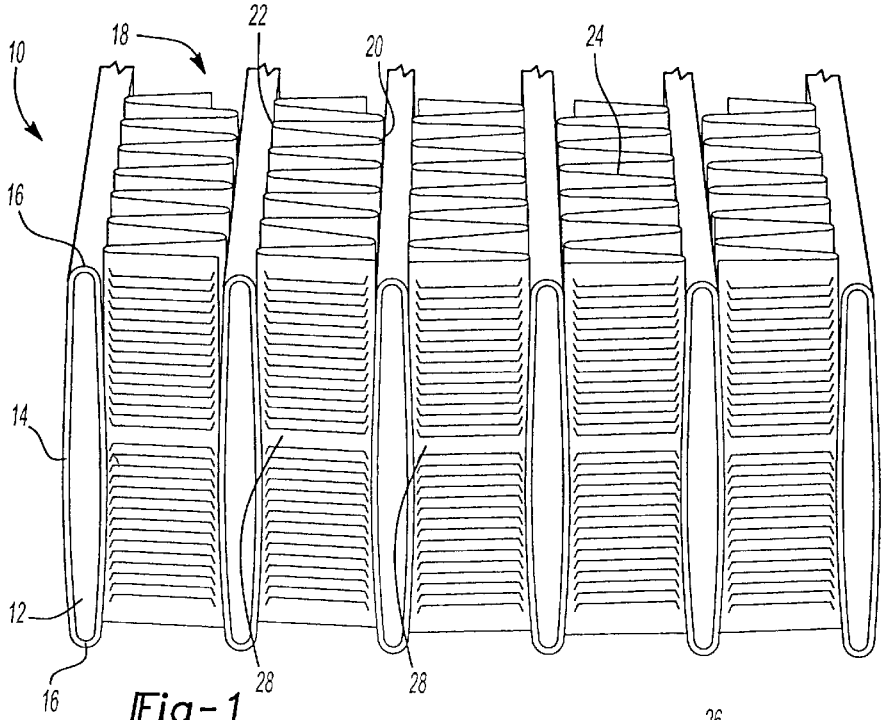
Fig-1 PRIOR ART
FIG. 1 is a perspective view of a segment of a prior art heat exchanger assembly of air center convoluted folded fins alternating with welded coolant tubes.
Figure 2:
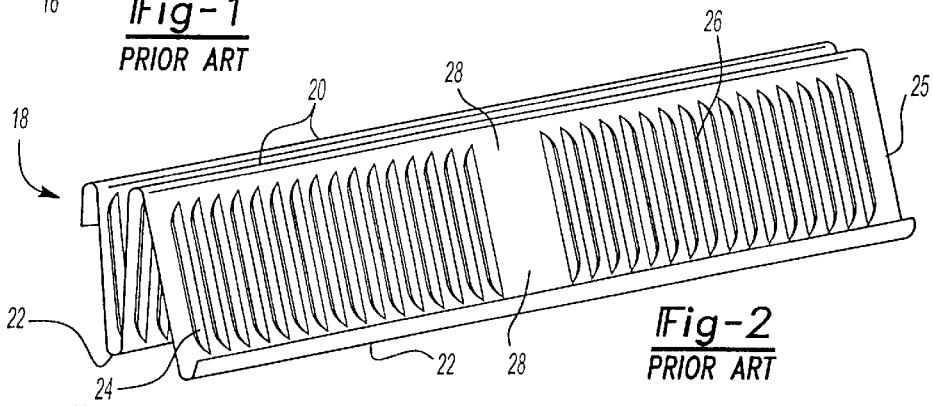
Fig-2 PRIOR ART
FIG. 2 is an elevation front view of a prior art air center fin.
Figure 3:
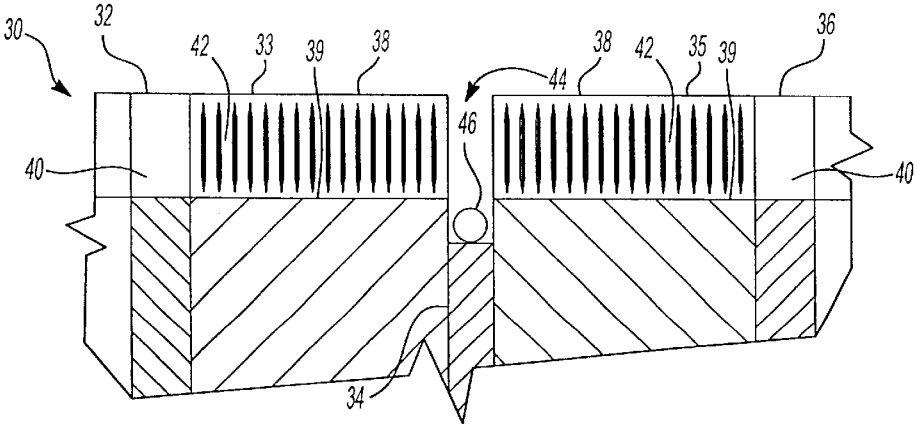
Fig-3 PRIOR ART
FIG. 3 is a partial cross-sectional view of a disk stack utilized to form the prior art air center fins.
Figure 4:
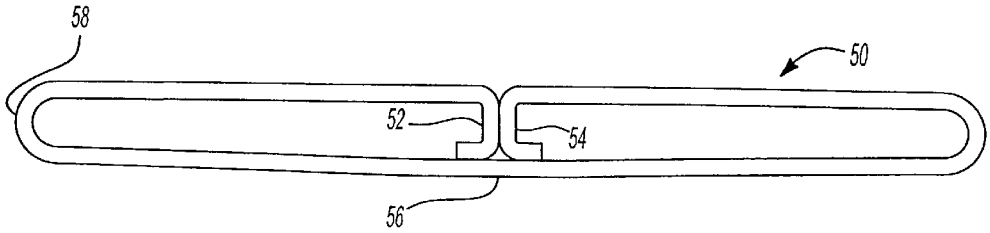
FIG. 4 is a cross sectional view of a folded coolant tube.

To form air center 60 with a reduced height middle margin turnaround 68, a form roll disc stack that is modified from the disc stack described with respect to FIG. 3, above is utilized. Such a modified form roll 70 is illustrated in FIGS. 6–7. Form roll 70 (form roll 71 being substantially identical thereto) is comprised of a stack of form discs 82–84 and 86–88 and at least one stripper disc 85. Form roll 70 has a plurality of star-shaped teeth 72 wherein each tooth 72 has a top point 93, the tops points 93 defining a major diameter of the form roll 70. Each adjacent pair of teeth 72 adjoin at their respective bases to define valleys 94, the valleys 94 defining a minor diameter of the form roll 70. End discs 82 and 88 are spaced one from another and include plain faces 90 on each side thereof to form ends 65 of convolution leg 62. Louver forming discs 83 and 87 are abutted to and positioned interiorly of end discs 82 and 88 respectively. Louver forming discs 83 and 87 include on each side of their respective teeth 72, faces 91 configured to form louvers 63 in convolution leg 62. Discs 82, 83, 87, and 88 combine to define top point 93 of form roll 70.

Modified discs 84 and 86 are positioned such that disc 84 is positioned interiorly of disc 83 and disc 86 interiorly of disc 87. Each of discs 84 and 86 have a louver forming face 92 substantially coplanar with the louver forming faces 91 of discs 83 and 87. Discs 82–84 and 86–88 have their respective teeth aligned to form teeth 72 with top points 93 and valleys 94 of form roll 70. A stripper disc 85 is positioned interiorly of discs 84 and 86 and is the central disc of the disc stack. Stripper disc 85 has a diameter that is smaller than the diameter circumscribed by valleys 94 and thus in combination with discs 84 and 86 defines a gap 96 therebetween. A stripper finger 73 is at least partially received within gap 96 while remaining below valleys 94 so as not to interfere with the intermeshing teeth 72 and the formation of folded strip 80. Discs 82–84 and 86–88 are constructed such that valley 94 is colinear thereacross. However, uppermost point 93 of tooth 72 is defined by the top edge of the teeth 72 of discs 82, 83, 87, and 88. Discs 84 and 86 have modified teeth 89 with a reduced pitch top edge 95 that circumscribes a diameter smaller than the diameter circumscribed by top points 93 of teeth 72. Since faces 92 of discs 84 and 86 are substantially coplanar with faces 91 of discs 83 and 87, top edge 95 of discs 84 and 86 have a larger tip radius than the top edge corresponding to top point 93 of discs 82, 83, 87, and 88.

In operation, as form rolls 70 and 71 rotate in their respective directions 74 and 76, blank strip 78 is fed therebetween along direction 77 such that teeth 72 of the respective form rolls 70, 71 engage blank strip 78 and form folded strip 80 therefrom. Form rolls 70, 71 intermeshingly engage with respect to each other in a manner to produce the desired height of air center 60 and the corresponding tip radii 64, 66. Top edge 95 of discs 84 and 86 being lower than the top edge 93 of the remaining discs results in an additional clearance above top edge 95. The additional clearance above top edge 95 in combination with the larger radius thereof result in the portion of the top and bottom tip radii at middle margin turnaround 68 formed over the width of discs 84 and 86 to then form with a larger tip radius. The top edges 95 of discs 84 and 86 being of reduced height no longer push a portion of the strip 78 toward the region above stripper disc 85. Discs 82, 83, 87 and 88 set the top tip and bottom tip radii 64 and 66 over ends 65 and louver banks 63, and a smooth transition occurs at the tip radius above discs 84 and 86. Since discs 84 and 86 do not push material into gap 96, the tip radii formed in this area results in a middle margin turnaround 68 that has a height smaller than the remainder of leg 62. As folded strip 80 exits from between form rolls 70 and 71, stripper finger 73 being partially received in gap 96 causes folded strip 80 to disengage from the teeth 72 of form roll 70. Folded strip 80 can then be cut to a desired length to form a desired air center 60.

Figure 8:
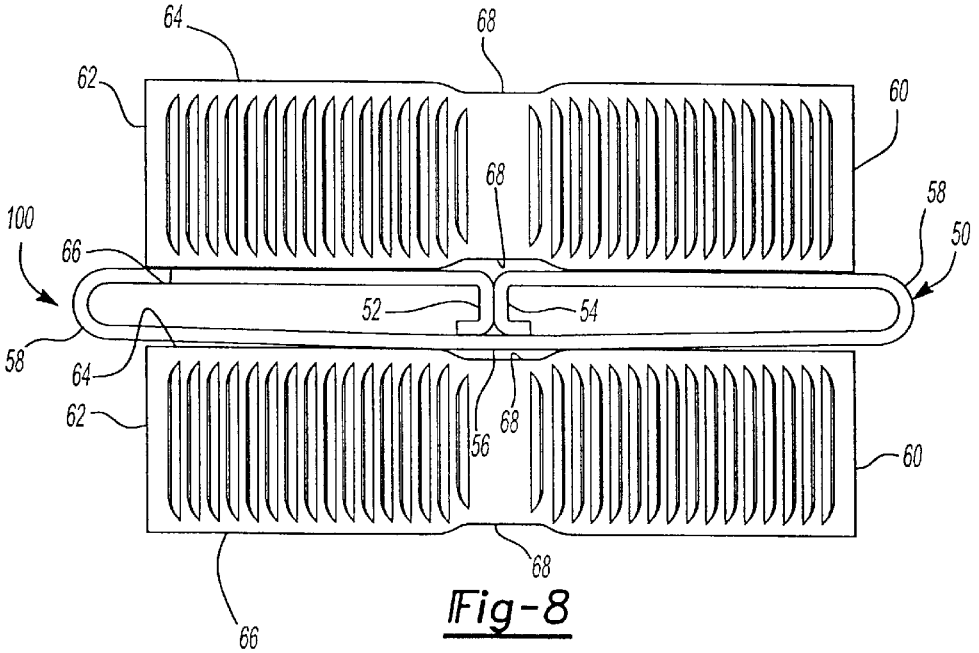
FIG. 8 is a view of a segment of a heat exchanger assembly of air center convoluted folded fins with a reduced middle margin alternating with folded coolant tubes.

FIG. 8 illustrates a portion of a heat exchanger core 100 illustrating the mating of a folded tube 50 with adjoining air centers 60. Tubes 50, having a central portion 56 that is essentially non-compressible as a result of folded legs 52 and 54 is abutted to a top tip radius 64 of a first air center 60 and on an opposite side thereof to the bottom tip radius 66 of a second air center 60. Air centers 60 are positioned along tube 50 such that central portion 56 is substantially aligned with the reduced height of middle margin turnaround 68. Since the portion of tube 50 between center portion 56 and ends 58 remains compressible, a stack of a plurality of tubes 50 and air centers 60 can be compressed to conform to the overall required width of core 100. In this manner top tip radii 64 and bottom tip radii 66 are substantially abutted against the respectively adjacent tubes 50 without middle margin turnaround 68 interfering with the non-compressible central portion 56 of tube 50. After compression of the stacked core 100, the tip radii 64 and 66 are sufficiently abutted to the sides of tube 50 to permit the metallurgical bonding therebetween to form the completed core 100.

In the foregoing description those skilled in the art will readily appreciate that modifications may be made to the invention without departing from the concepts disclosed herein. Such modifications are to be considered as included in the following claims, unless these claims expressly state otherwise.

I claim:

1. An improved air center form roll for use in combination with a like form roll to produce an accordion-like folded fin for a heat exchanger core, said form roll being of the type comprising a plurality of form discs abutted one to the other and having a plurality of star-like teeth thereabout, points of said star-like teeth defining a major diameter of said form roll and valleys between adjacent ones of said star-like teeth defining a minor diameter of said form roll, and further including at least one stripper disc having no teeth therearound and interposed between at least two of said plurality of form discs, wherein said stripper disc has a diameter less than said minor diameter of said form roll, the improvement comprising:

a modified disc having a plurality of modified star-like teeth thereabout, said modified disc interposed at each abutment between said at least one stripper disc and one of said at least two form discs, said modified disc further having a major diameter defined by points of said modified star-like teeth, said major diameter of said modified disc being smaller than said major diameter of said plurality of form discs.

2. The improved form roll according to claim 1 wherein said modified disc has a minor diameter defined by valleys between adjacent ones of said modified star-like teeth, said minor diameter of said modified disc being substantially equal to said minor diameter of said form roll.

3. The improved form roll according to claim 2 wherein said points of said star-like teeth of said modified disc have a first radius, and said points of said star-like teeth of said form roll have a second radius, said first radius and said second radius being unequal.

4. The improved form roll according to claim 3 wherein said first radius is larger than said second radius.

5. The improved form roll according to claim 4 wherein each said star-like tooth of said form roll has two faces, and each said star-like tooth of said modified disc has two faces, and further wherein said faces of said modified disc star-like teeth are substantially coplanar with said faces of said form roll star-like teeth.

6. The improved form roll according to claim 1 wherein said points of said star-like teeth of said modified disc have a first radius, and said points of said star-like teeth of said form roll have a second radius, said first radius and said second radius being unequal.

7. The improved form roll according to claim 6 wherein said first radius is larger than said second radius.

8. The improved form roll according to claim 1 wherein each said star-like tooth of said form roll has two faces, and each said star-like tooth of said modified disc has two faces, and further wherein said faces of said modified disc star-like teeth are substantially coplanar with said faces of said form roll star-like teeth.

9. A method of improving a form roll utilized to form a folded fin for use in a heat exchanger core, the form roll being of the type comprising a plurality of form discs abutted one to the other and having a plurality of star-like teeth thereabout, points of the star-like teeth defining a major diameter of the form roll and valleys between adjacent ones of the star-like teeth defining a minor diameter of the form roll, and further including at least one stripper disc having no teeth therearound and interposed between at least two of the plurality of form discs to abut with the two form discs, wherein the stripper disc has a diameter less than the minor diameter of the form roll, said method including the steps of:

fabricating a plurality of modified discs, each modified disc having a plurality of modified star-like teeth thereabout and further having a major diameter defined by points of the star-like teeth, the major diameter of the modified disc being smaller than the major diameter of the plurality of form discs;

interposing one modified disc between each abutted form disc and stripper disc;

aligning the star-like teeth of the modified disc with the star-like teeth of the form discs.

10. The method of claim 9 wherein the modified disc of said fabricating step has a minor diameter defined by valleys between adjacent ones of the modified star-like teeth, the minor diameter of the modified disc being substantially equal to the minor diameter of the form roll.

11. The method of claim 9 wherein the modified disc of said fabricating step includes points of the star-like teeth of the modified disc having a first radius, the first radius being larger than a second radius of the points of the star-like teeth of the form roll.

12. A method of making a folded fin air center having a reduced height middle margin turnaround for use in a heat exchanger core, said method including the steps:

providing a pair of form rolls, each form roll being of the type comprising a plurality of form discs abutted one to the other and having a plurality of star-like teeth thereabout, points of the star-like teeth defining a major diameter of the form roll and valleys between adjacent ones of the star-like teeth defining a minor diameter of the form roll, and further including at least one stripper disc having no teeth therearound and interposed between at least two of the plurality of form discs, wherein the stripper disc has a diameter less than the minor diameter of the form roll, and wherein the form discs abutting the stripper disc are modified form discs having modified star-like teeth therearound, points of the modified teeth defining a major diameter of the modified disc to be less than the major diameter of the form roll;

rotating the form rolls in opposite directions in a manner to cause the star-like teeth of one form roll to intermesh with the star-like teeth of the other form roll;

feeding a blank strip of heat conductive material between the rotating form rolls;

allowing the teeth of each form roll to engage the blank strip;

forming the blank strip over the point of an opposing tooth to form a tip radius adjoining legs of a folded fin;

causing the strip to be further drawn over the point of the opposing tooth to form a leg having a height at a middle margin turnaround in the region over the modified discs and the stripper disc less than the height of the remainder of the leg over the region of the plurality of form discs.

13. The method of claim 12 wherein said providing step includes providing the modified form discs wherein the points of the modified star-like teeth have a larger radius than the points of the plurality of form discs.

14. The method of claim 13 wherein the causing step further causes the radius of the tip radius to have a larger radius in the middle margin turnaround than the tip radius in the remaining regions of the formed strip.

* * * * *